US005365674A

United States Patent [19]

Etchegoyhen et al.

[11] Patent Number: 5,365,674

[45] Date of Patent: Nov. 22, 1994

[54] DEVICE FOR MEASURING THE DISPLACEMENT OF A SWIVEL OF A DRILLING MAST

[75] Inventors: Didier Etchegoyhen, Agnos; Henry Henneuse, Billere, both of France

[73] Assignee: Elf Aquitaine Production, France

[21] Appl. No.: 940,946

[22] PCT Filed: Feb. 27, 1992

[86] PCT No.: PCT/FR92/00179

§ 371 Date: Dec. 14, 1992

§ 102(e) Date: Dec. 14, 1992

[87] PCT Pub. No.: WO92/15772

PCT Pub. Date: Sep. 17, 1992

[30] Foreign Application Priority Data

Mar. 1, 1991 [FR] France ..... 91 02453

[51] Int. Cl.[5] ..... E21B 47/04

[52] U.S. Cl. ..... 33/719; 33/711; 33/702; 33/775

[58] Field of Search ..... 33/707, 710, 711, 716, 33/719, 772, 773, 775, 702, 778

[56] References Cited

U.S. PATENT DOCUMENTS

| | | | |
|---|---|---|---|
| 3,005,264 | 10/1961 | Shaffer . | |
| 3,520,062 | 7/1970 | Tanguy . | |
| 3,688,410 | 9/1972 | Zeidler et al. | 33/773 |
| 4,535,541 | 8/1985 | Penning | 33/711 X |
| 4,830,119 | 5/1989 | Haney et al. . | |

FOREIGN PATENT DOCUMENTS

| | | | |
|---|---|---|---|
| 0157805 | 12/1981 | Japan | 33/778 |

*Primary Examiner*—William A. Cuchlinski, Jr.
*Assistant Examiner*—Alvin Wirthlin
*Attorney, Agent, or Firm*—Bacon & Thomas

[57] ABSTRACT

A device for measuring the movement of a drill pipe string, the end of which is held during drilling by an attachment assembly (12) movably along at least one guide rail (16), comprises a sensor assembly (38) mounted on the attachment assembly with a roller (42) designed to run on the rail as the attachment assembly moves.

4 Claims, 2 Drawing Sheets

DEVICE FOR MEASURING THE DISPLACEMENT OF A SWIVEL OF A DRILLING MAST

BACKGROUND OF THE INVENTION

1. Technical Field of the Invention

The present invention relates to a device for measuring the displacement of a swivel of a drilling mast, and, more particularly, to such a device which is intended to manage the position of the tool in the well as well as the bottom dimension of this same well.

2. Description of the Prior Art

Two types of devices exist which are able to be used on a drilling mast so as to rotationally drive a string of pipes. The first, and the more conventional, is the turntable which is mounted on the floor of the drilling mast and comprises a square or hexagonal opening intended to receive a driving pipe of complementary cross-section. The table is set in rotation and thus gives rise to the rotation of the string of pipes.

The other type of device is the motorised swivel, wherein an electric or hydraulic motor, mounted adjacent to the travelling block, is directly connected to the upper end of the string of pipes. The motor is mounted on a carriage which slides on rails arranged vertically on the mast thus allowing the displacement of the carriage whilst absorbing the torque generated during drilling.

Regardless of the type of driving device, the driller always needs to determine the exact position of the elements of the string of pipes, and in particular of the tool arranged in the well so as to manage the drilling better. The conventional manner for determining the position of the tool consisted simply in noting the number of pipes as well as the other elements of the mass-of-pipes and stabilisers packing used and to deduce the total length therefrom. Taking into account the significant number of pipes used, a number reaching several hundred for a deep drilling, the possibility of error was not negligible. However, the consequences of such an error can be very severe if an operation is undertaken in the well at an incorrect depth.

With a motorised swivel, the alternated displacement along the rails is directly linked to the length of the pipes inserted in the drilling well. Thus, careful measurement of the total displacement of the motorised swivel during a manoeuvre or whilst drilling makes it possible to determine, with precision, the position of the tool in the well, a position which is corrected or otherwise for thermal and pressure effects and for the extension effect of the string of pipes under its own weight.

SUMMARY OF THE INVENTION

The subject of the present invention is therefore a device for measuring the displacement of a swivel of a drilling mast, which device is of simple construction, is reliable and which makes it possible to determine the position of the tool and the bottom dimension in the drilling well.

In order to do this, the invention provides a device for measuring the displacement of the upper end of the drill-pipe string, the end being supported during drilling by a fastening assembly, which can move along at least one guide rail, the measuring device comprising a sensor assembly mounted on the fastening assembly and comprising a roller fitted so as to roll on the rail during the displacement of the fastening assembly.

BRIEF DESCRIPTION OF THE FIGURES OF DRAWING

Other features and advantages of the present invention will emerge more clearly from reading the description given hereafter, by way of example, with reference to the appended drawings in which.

DETAILED DESCRIPTION OF THE PREFERRED EMBODIMENTS

Figure 1:
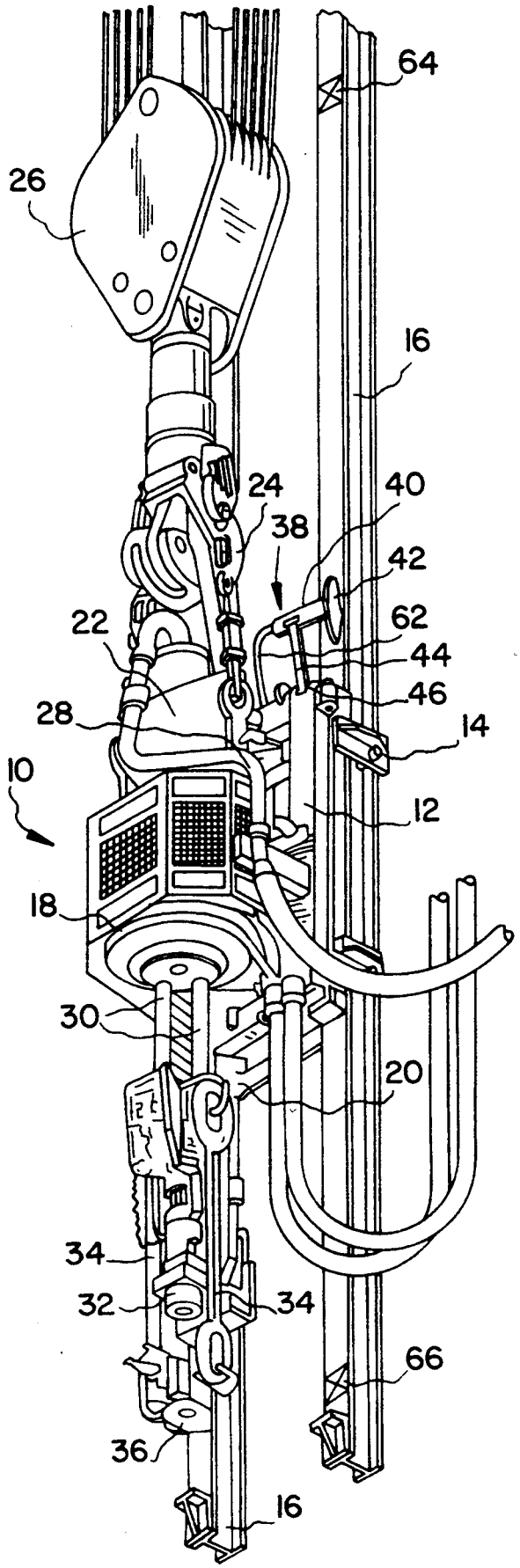
FIG. 1 is a perspective view of a motorised swivel.

FIG. 1 shows a motorised swivel 10 mounted fixed on a carriage 12 equipped with rollers 14 which allow it to slide on two rails 16 arranged vertically and integral with the drilling mast (not shown). The swivel 10 comprises a motor 18 which may be electric or hydraulic and which comprises a hollow main shaft 20 which is connected by a roller-contact bearing to a swivel 22 also mounted fixed to the carriage 12. In a conventional manner, the swivel is suspended from the hook 24 of the travelling block 26 which is part of the winch of the mast (not shown).

The swivel 22 is fed with mud, in a known fashion, by a hose 28 connected to a source of mud under pressure (not shown). Below the motor 18, and connected to the latter by torque-transmission arms 30, is the automatic spanners 32 and 34 assembly of the elevator 36.

According to the invention, a sensor assembly 38, mounted on the carriage 12, is adapted to measure the displacement of the carriage relative to the rails 16. The sensor element 38 comprises a body 40, which is substantially cylindrical, on which a roller 42 is mounted in free rotation. The sensor assembly 38 is mounted on the carriage 12 by means of a lever arm 44 which is mounted on a pivot 46 integral with the carriage 12. In order to hold the roller 42 in contact with the rail 16 the lever arm 44 is equipped with a return spring (not shown) whose task is to hold the sensor assembly 38 flat against the rail 16.

Figure 2:
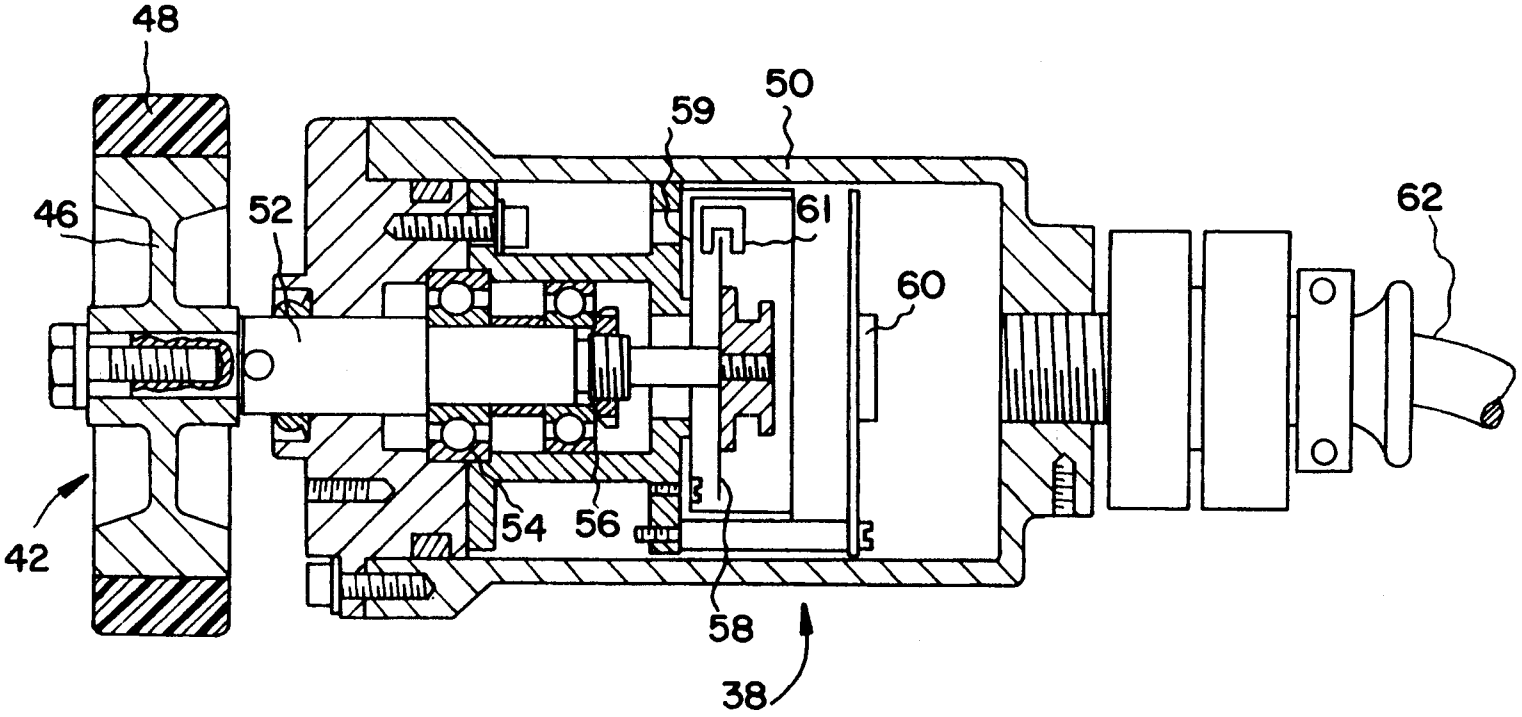
FIG. 2 is a view in longitudinal section of a sensor assembly according to the invention.

The sensor assembly 38 is shown in more detail in FIG. 2. The roller 42 comprises a metal hub 46 equipped with an outer ring 48, made for example from synthetic rubber. The sensor assembly 38 comprises a body 50 in which a shaft 52 is rotationally mounted by means of two roller-contact bearings 54 and 56. The roller 42 is mounted fixed to one end of the shaft 52 whose other end comprises a perforated disc 58 of an optical encoder whose electronics are shown schematically at 60. A light source 59 and a photosensitive cell 61 are arranged on either side of the perforated disc 58. In the example illustrated, the perforated disc comprises 1,000 sectors/revolution. The signals generated by the optical encoder 60 are sent, via a cable 62, to a processing centre (not shown), remote from the drilling mast. The sensor assembly 38 complies with explosion-proof standards.

The optical encoder 60 supplies two signals in quadrature which make it possible to calculate the length of the displacement of the sensor assembly relative to the rail 16, as well as its direction. By way of example, the signals coming from the optical encoder 60 join an up/down counters assembly slaving a 16-bit digital-analogue converter indicating the displacement of the carriage with a resolution less than one mm.

Two fixed reference points, shown schematically at 64 and 66 are mounted at the ends of the rail 16. A mechanical member not shown on the diagrams actuates an electric contact when passing in front of these reference points. The electronic counting system only resets itself during passages from top to bottom so as to avoid generating errors due to mechanical hysteresis. The reference point 66 at the bottom is intended to monitor and, possibly to correct, the signals indicating that the carriage 12 has reached its end position. The reference 64 at the top makes it possible to compensate for any wear of the roller 42 comparing the distance measured between the two reference points 64, 66 with the real distance and consequently adapting the sensor gain factor.

The measuring device according to the invention may also be used on a drilling mast equipped with a turntable provided that the mast is equipped with at least one guide rail for the travelling block on which guide rail the roller 42 of the sensor assembly can slide.

Regardless of the type of rotational drive device used, the measuring device makes it possible to measure, with great precision, the displacements of the carriage 12 as well as its direction and to be able to deduce therefrom the exact position of the tool in the well. Due to its great precision, it can be perfectly integrated with a system for automatically managing the lowering of the pipe packing and pipe extension. The device may also be used on a floating sea-drilling platform, provided that the processing centre for the signals is also connected to a second sensor of the same or other type intended to measure the vertical displacement of the platform relative to a fixed reference point, for example the extension tube more commonly termed "riser".

We claim:

1. A device for measuring the displacement of one end of a drill pipe string comprising a fastening assembly for supporting the end of said drill-pipe string, said fastening assembly being movable along at least one guide rail, a motorized swivel mounted on said fastening assembly and being movable therewith along said guide rail, a sensor assembly mounted on said fastening assembly and comprising a roller fitted so as to roll on said guide rail during displacement of said fastening assembly and means for measuring the distance transversed by the roller, said guide rail including means for calibrating the sensor assembly including two fixed reference points for sensing the presence of said roller, said reference points being in spaced apart relation on said guide rail, whereby the distance measured by the sensor assembly between said reference points can be compared to the actual, fixed distance therebetween to calibrate the sensor assembly.

2. The device according to claim 1, wherein said means for measuring the distance transversed by the roller comprises an optical encoder connected to said roller.

3. The device according to claim 1, where said sensor assembly is mounted on said fastening assembly by means of a spring-biased lever arm which is mounted on a pivot integral with said fastening assembly.

4. The device according to claim 1, wherein said roller comprises a metal hub equipped with an outer ring made from synthetic rubber.

* * * * *